US005339664A

United States Patent [19]

Mellor

[11] Patent Number: 5,339,664

[45] Date of Patent: Aug. 23, 1994

[54] SYSTEM FOR IDENTIFYING, CARRYING AND STORING KEYS

[76] Inventor: H. Clay Mellor, R.D. 1, Box 356, Rochester, Vt. 05767

[21] Appl. No.: 804,931

[22] Filed: Dec. 11, 1991

[51] Int. Cl.[5] ..... A44B 15/00; A47G 29/10

[52] U.S. Cl. ..... 70/456 R; 70/460; 70/459

[58] Field of Search ..... 206/37.1, 37.8; 70/456 R, 456 B, 457, 460, 458, 459; 24/3 K, 590, 591

[56] References Cited

U.S. PATENT DOCUMENTS

| | | | |
|---|---|---|---|
| 874,957 | 12/1907 | Godley | 70/459 |
| 930,776 | 11/1909 | Milleson . | |
| 1,692,686 | 4/1924 | Nichols . | |
| 1,816,642 | 2/1929 | Fetter . | |
| 1,868,563 | 4/1930 | Cicourel . | |
| 1,877,909 | 3/1930 | L'Enfant . | |
| 1,983,747 | 12/1934 | Gahagen | 70/38 B |
| 2,071,021 | 3/1936 | Brandt | 24/3 |
| 2,159,322 | 6/1937 | Drummond | 46/19.5 |
| 2,312,204 | 2/1943 | Weindel, Jr. | 70/457 |
| 2,771,768 | 11/1956 | Tudor | 70/457 |
| 2,845,672 | 8/1958 | Molene | 70/457 |
| 2,964,937 | 6/1959 | Lautin | 70/456 |
| 2,978,897 | 6/1959 | Capitani | 70/456 |
| 3,415,300 | 12/1968 | Worcester | 248/205.2 |
| 3,906,763 | 9/1975 | Bochory | 70/456 R |
| 4,004,325 | 1/1977 | Hubachek | 24/3 |
| 4,072,033 | 2/1978 | Eckerdt | 70/456 B |
| 4,271,352 | 6/1981 | Thomas | 235/375 |
| 4,306,433 | 12/1981 | Kelly | 70/456 R |
| 4,425,772 | 1/1984 | Brewer | 70/456 R |
| 4,512,168 | 4/1985 | Reitze | 70/456 R |
| 4,713,951 | 12/1987 | Ros | 70/456 R |
| 4,799,587 | 1/1989 | Desanto | 206/37.6 |

FOREIGN PATENT DOCUMENTS

| | | | |
|---|---|---|---|
| 0149102 | 7/1985 | European Pat. Off. | 70/459 |
| 2225605 | 6/1990 | United Kingdom | 70/459 |

OTHER PUBLICATIONS

The Sharper Image Catalog, Oct. 1991, p. 61.

*Primary Examiner*—Peter M. Cuomo
*Assistant Examiner*—Darnell M. Boucher
*Attorney, Agent, or Firm*—Cushman, Darby & Cushman

[57] ABSTRACT

A system for identifying, carrying and storing keys including a portable holder having a body with a central portion and outer peripheral edge. The body includes at least one receptacle extending from the outer peripheral edge toward the central portion. The receptacle includes a bore and a locking shoulder within the bore. The system includes at least one insert configured to be insertable into and removed from a receptacle. The insert includes a member engaging the locking shoulder so as to lock the insert in the receptacle. An element for coupling at least one key to the insert is also provided.

23 Claims, 5 Drawing Sheets

SYSTEM FOR IDENTIFYING, CARRYING AND STORING KEYS

BACKGROUND OF THE INVENTION

This invention relates to key holders and in particular to a system for identifying, carrying and storing keys.

Today, people are required to carry a variety of keys which may be used daily. There are house keys, car keys, office keys, boat keys, desk keys and so on. Conventional means of carrying such keys is to place all keys on a single key ring. However, there are times when a need exists to transfer a key or two to a friend or relative, which can then become mixed with their keys, causing one to forget which key fits which lock. Also, keys less frequently used are conventionally stored in various places in the home, usually not a centralized area, thus requiring a frantic search when such keys are needed. In addition, such less frequently used keys are not easily attached to typical key rings.

In an attempt to alleviate these problems, devices have been developed for labeling, storing and carrying keys, all of which have their own shortcomings in utility or appeal. These devices tend to be cumbersome, making them difficult to carry. Many of these devices do not facilitate easy transfer of key sets, do not provide an adequate storage holder for the keys, and do not provide a safe means of returning lost keys.

Accordingly, it can be appreciated that a need exists to provide a system for identifying, carrying and storing a variety of keys which overcomes the inadequacies of the prior art.

SUMMARY OF THE INVENTION

An object of the present invention is to fulfill the need referred to above. In accordance with the principles of the present invention, this objective is obtained by providing a system for identifying, carrying and storing keys comprising a portable holder including a body having a front surface, back surface, central portion and outer peripheral edge, the body including at least one receptacle extending from the outer peripheral edge toward the central portion. The receptacle includes a bore and a locking shoulder within the bore. At least one insert is provided, being configured to be insertable into and removed from a receptacle. The insert has a distal portion and a proximal portion, the distal portion includes a member for engaging the locking shoulder so as to lock the insert in the receptacle. A coupling member is provided to couple at least one key to the insert.

Other objects, features and characteristics of the present invention, as well as the function of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 2:
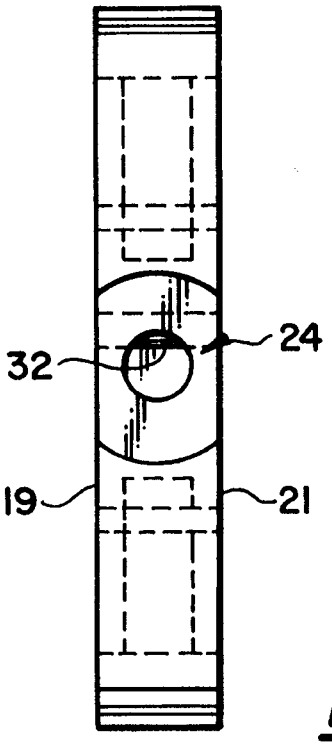
FIG. 2 is a side elevation of the portable holder shown in FIG. 1.

Referring now to the drawings, a system is shown for identifying, storing and carrying keys, generally indicated at 10, which embodies the principles of the present invention. The system 10 advantageously includes a portable holder, generally indicated at 12, a plurality of similarly configured inserts, one of which is generally indicated at 14, and a storage holder 16.

Figure 1:
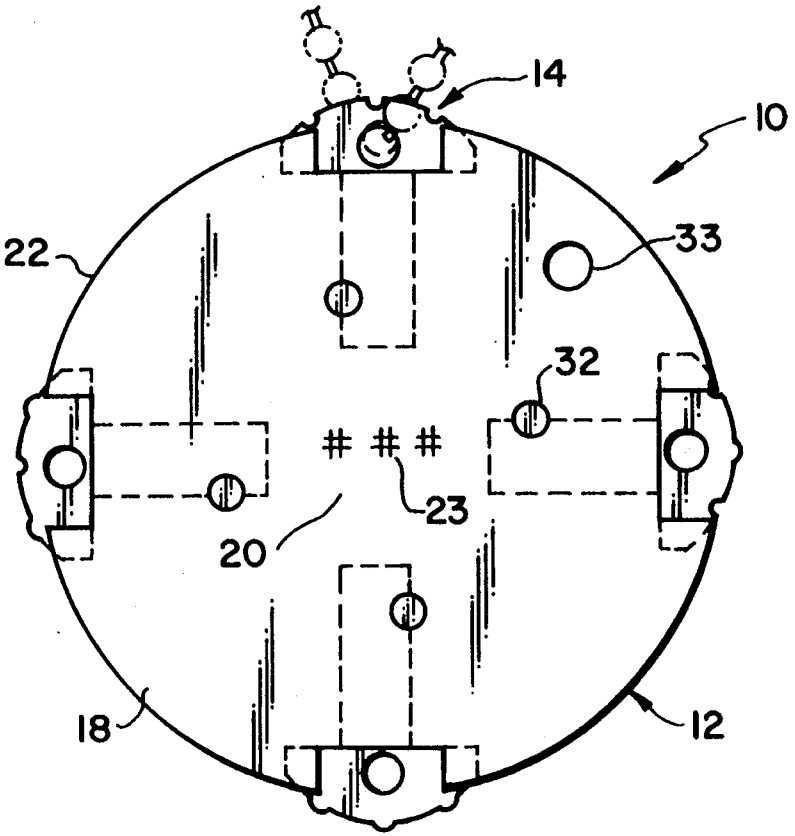
FIG. 1 is front elevation view of a portable holder including inserts embodying the principles of the first embodiment of the present invention.
Figure 15:
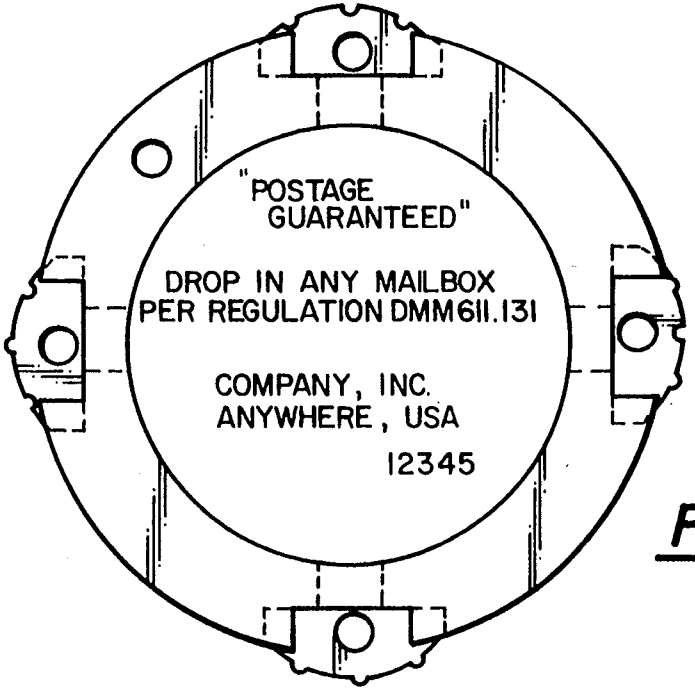
FIG. 15 is a rear elevation of a portable holder including inserts provided in accordance with the first embodiment of the present invention.

As will become more apparent below, the portable holder 12 may be provided in a number of configurations. However, referring more particularly to FIG. 1, the portable holder 12 preferably has a generally circular configuration and is sized to fit comfortably into ones' pocket or purse. The body 18 of holder 12 has a central portion 20 and a peripheral edge 22, a front 19 and back 21. Inscribed on the back 21 are instructions in the event the holder 12 is lost, such as "Drop in any mailbox", along with an address, preferably other than a home address, for obvious reasons, such as a company or bank name and address, as shown in FIG. 15. On the front 19, as shown in FIG. 1, a code number 23 for the portable holder may be inscribed. Thus, each portable holder 12 can be registered by using the code number 23 and safely returned to the owner through the bank or company address, without disclosing the residence of the owner.

Figure 1B:
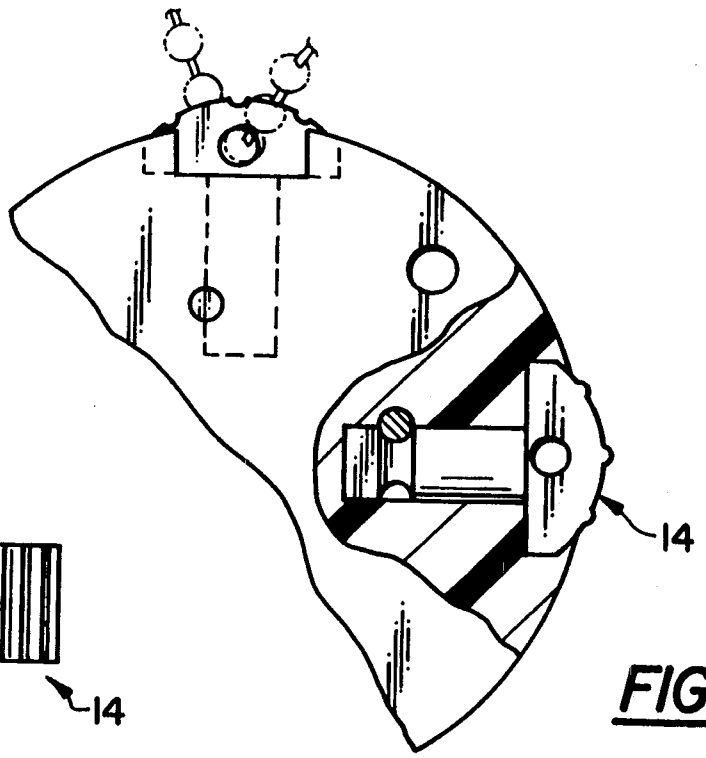
FIG. 1B is front elevation view, partly in cross section and partly broken away for clarity for showing the insert rotated 90 degrees engaging a pin in a receptacle provided in accordance with the first embodiment of the present invention.
Figure 1A:
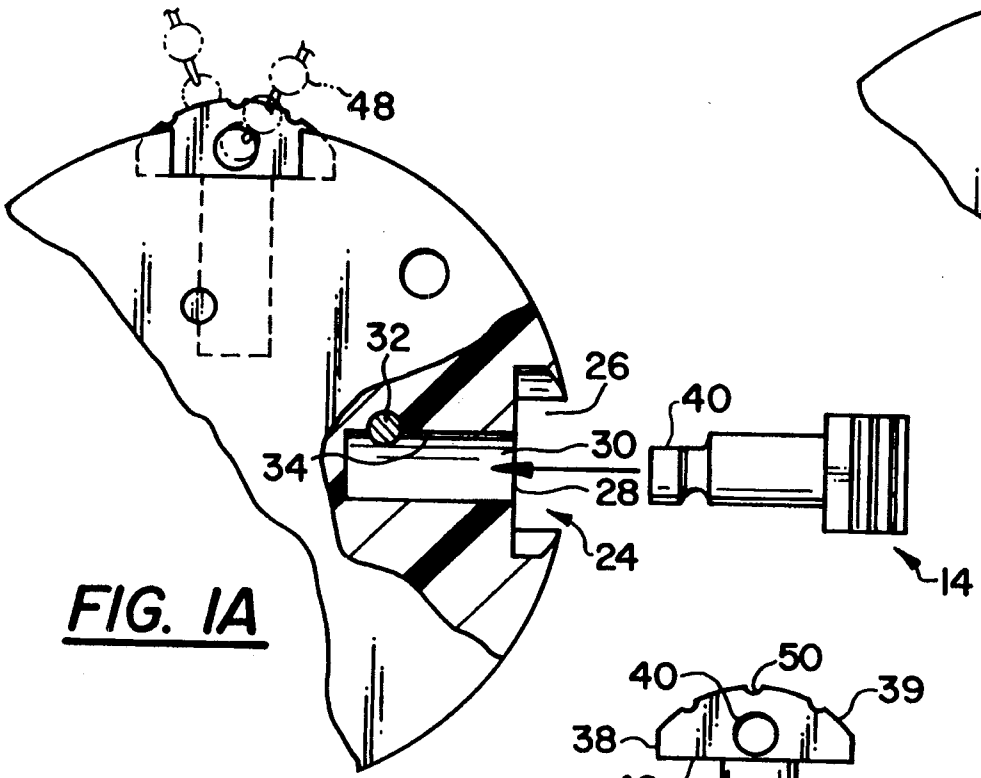
FIG. 1A is front elevation view, partly in cross section and partly broken away for clarity for showing the insertion of an insert into a receptacle provided in accordance with the first embodiment of the present invention.

A plurality of uniformly spaced receptacles, generally indicated at 24, are defined in the peripheral edge 22. In the illustrated embodiment, four receptacles are provided (FIG. 1). However, the number of receptacles may be increased or decreased as desired. The receptacles 24 are in the form of radial bores which extend toward the central portion 20. More particularly, each of the receptacles 24 includes a recess 26 in the peripheral edge and a bore 30 of smaller size than recess 26 extending radially inwardly from recess 26. Thus, a ledge 28 is formed in the body 18, as shown in FIG. 1A. The ledge 28 extends from the front 19 to the back 21 of the body 18.

In accordance with a first embodiment of the present invention, the bore is round and a pin-shaped projection 32 is positioned therein so that approximately one-half of the pin-shaped projection 32 extends from a side wall 34 into the bore 30, while the other half of the pin-shaped projection 32 is embedded in the body 18. A hole 33 is provided through the body 18 affixing an often-used key thereto by utilizing a key chain, monofilament line or ring.

Figure 3:
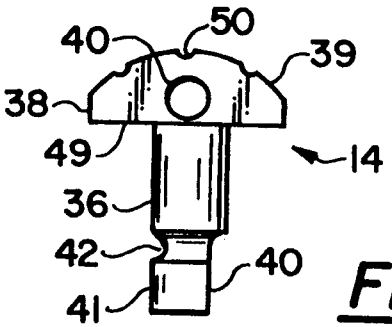
FIG. 3 is a front elevation view of an insert provided in accordance with the first embodiment of the present invention requiring 180 degree rotation to lock the insert into a receptacle.

The system 10 further includes a plurality inserts 14, which are selectively detachably insertable into receptacles 24. One embodiment of the insert 14 is shown in FIGS. 1A and 3. This embodiment of the insert is adapted to be inserted into a holder provided in accordance with the first embodiment. In accordance with this embodiment, each insert 14 includes a distal portion 36 and a proximal portion 38. The distal portion of each insert 14 includes a flat portion 40 disposed parallel to the longitudinal axis of the insert and a part-cylindrical portion 41. A groove 42 is defined in the part-cylindrical portion 41. The flat portion 40 allows the insert body to pass the pin-shaped projection 32 when the insert 14 is inserted into the receptacle 24, as shown in FIG. 1A. Once the insert 14 is fully inserted, the groove 42 is aligned with the pin (FIG. 1B). The proximal portion 38 of the insert 14 can then be gripped and rotated, so that the groove 42 engages the projection 32. The pin-shaped projection 32 provides a locking shoulder so that engagement of the projection 32 and the lateral groove 42 retains the insert 14 in the receptacle 24. As shown in FIGS. 1A and 1B, the insert must be rotated 90 degrees to permit the groove 42 to mate with the pin-shaped projection 32. However, the amount of rotation required to retain the insert in the receptacle is dependent upon the location of flat 40. A variation of the location of flat 40 is shown in FIG. 3. Flat 40 is disposed 90 degrees from the position shown in FIG. 1A, thus being perpendicular to the longitudinal axis of the proximal portion 38. Such location of flat 40 requires 180 degree rotation to retain the insert 14 in the receptacle.

In the illustrated embodiment, the proximal portion 38 of the insert 14 is larger than the distal portion 36, thus creating a flat surface 44 which engages with the ledge 28 when the insert 14 is placed into a receptacle 24. The proximal portion 38 includes a curved outer edge 39. A bore 46 is disposed through the proximal portion 38 for accepting a key chain, monofilament line or ring 48. Along the curved outer edge 39 of the proximal portion 38 are a plurality of recesses 50, and/or projections 51 so that each insert 14 can be identified by tactile perception. A different combination of recesses 50 and/or projections 51 is used for each insert 14, as shown in FIG. 1. Also, each insert may be color-coded providing visual identification of a particular key set.

Each insert 14 can be placed in any receptacle 24. The outer edge 39 of the proximal portion 38 of the inserts 14 extends slightly beyond the peripheral edge 22 of the portable holder 12, permitting access to the insert for removal.

Figure 5:
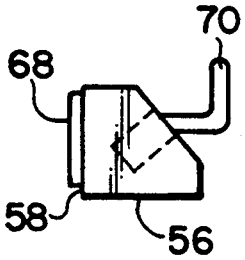
FIG. 5 is a side elevation of the storage holder shown in FIG. 4.
Figure 4:
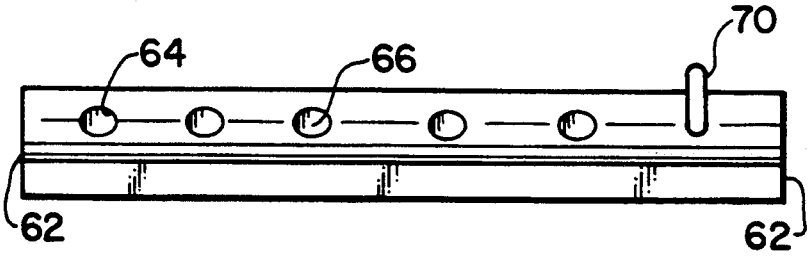
FIG. 4 is a front elevation of a storage holder provided in accordance with the first embodiment of the present invention.
Figure 6:
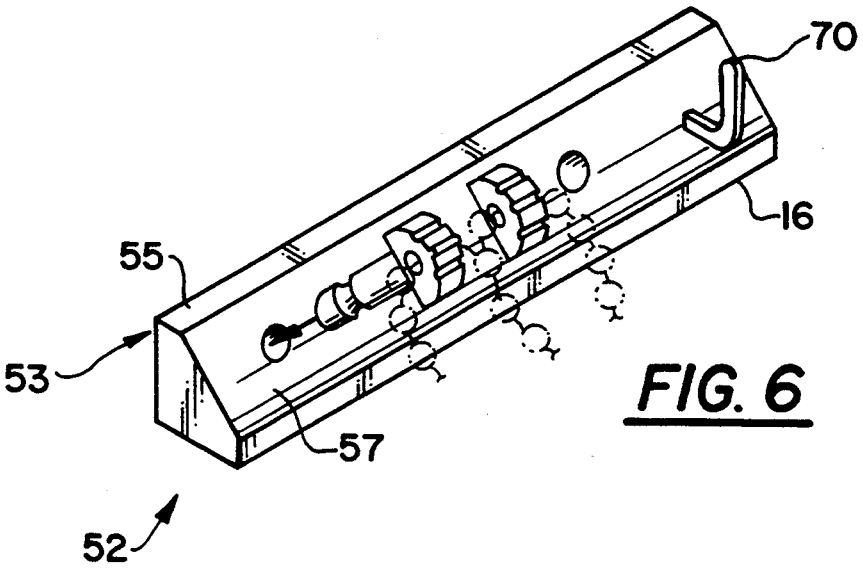
FIG. 6 is a perspective view of a storage holder shown in FIG. 4, including inserts inserted therein.

Referring now more particularly to FIGS. 4 through 6, an exemplary configuration of a storage holder, in accordance with the invention, is shown. The storage holder 16 can be attached to the inside of a table drawer or a closet door and used for storing inserts 14 when they are not placed in the portable holder 12, and for storing the inserts at night. The storage holder 16 comprises a body 52, of generally rectangular configuration including a top surface 53 having a horizontal surface 55 and an inclined surface 57, a bottom surface 56, a back surface 58, a front surface 60 and side surfaces 62. A number of blind holes 64 are uniformly spaced within the body, with the opening 66 of each blind hole 64 preferably disposed at the top inclined surface 57. There are preferably enough blind holes 64 to accommodate at least the number of inserts 14, which may be more than the number of receptacles in the portable holder. Each blind hole 64 is sized to accept the distal portion 36 of each insert 14 for storing inserts 14, not required to be carried in the portable holder 12. As an alternative to the blind holes 64, a series of receptacles as in the portable holder 12 can be provided in the storage holder 16. Mounting means 68 are provided on the back surface 58 of the body 52. As shown in FIG. 5, the mounting means 68 can include a hook and loop type material strip, double-backed adhesive tape or the like secured to the back surface 58. A hook 70 may be disposed on surface 57 for holding an insert by hanging the key chain, ring or monofilament line thereon. The portable holder 12 may be stored on the hook 70 nightly, with particular inserts 14 selected daily and placed into the portable holder 12.

A second embodiment of the insert 14 and portable holder 12 is shown in FIGS. 7 through 12. The portable holder 12 and insert 14 are similar in many respects to that of the first embodiment. Accordingly, corresponding parts are assigned the same reference numbers and will not be specifically discussed.

In this embodiment, the receptacle 24 is rectangular or square bore, rather than circular in cross-section. Further, referring to FIG. 11, the locking shoulder is a locking edge 82 defined by a cut-out 83 in wall 84 of bore 30, rather than a pin.

Disposed in the front 19 of the body 18, so to be aligned with the locking edge 82, is a shallow recess 86 creating a thin wall 88 between the shallow recess 86 and the cut-out 83, the function of which will become more apparent below. As an alternative to providing the thin wall 88, the cut-out 83 may extend from wall 84 to the front 19 of the body, or from wall 106 through to the back 21 of the body, or from the front 19 through bore 30 to the back 21 of the body, to define one or more locking edges 82.

Figure 10:
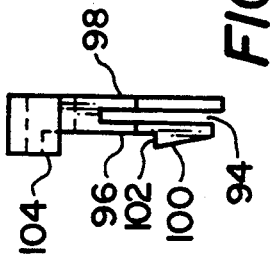
FIG. 10 is a side elevation of the insert shown in FIG. 9.
Figure 7:
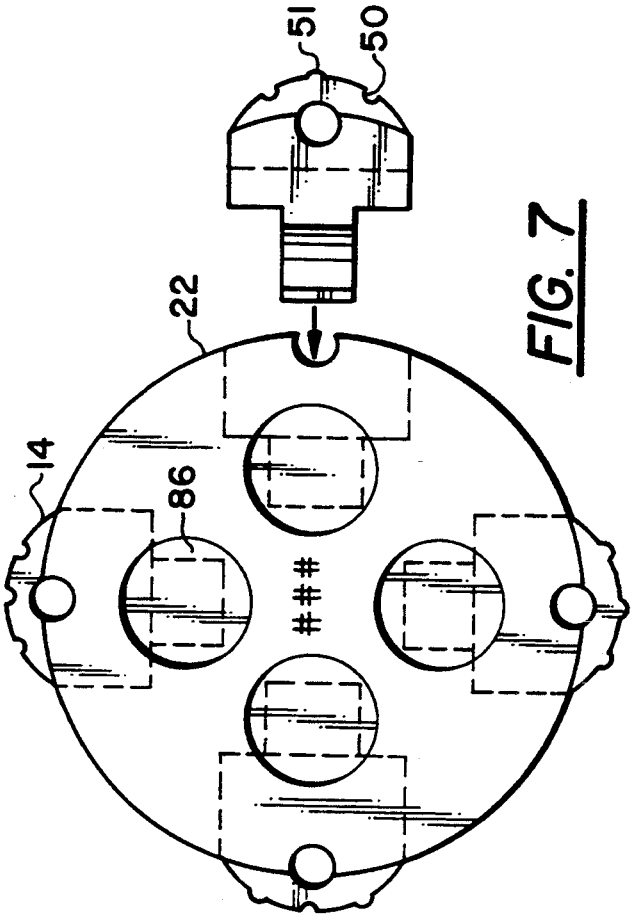
FIG. 7 is front elevation view of a portable holder including inserts embodying the principles of the second embodiment of the present invention.
Figure 9:
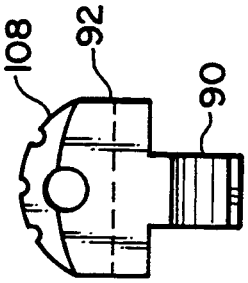
FIG. 9 is a front elevation view of an insert provided in accordance with the principles of the second embodiment of the present invention.

The second embodiment of the insert 14 is shown in FIGS. 9 and 10. Each insert 14 includes a distal portion 90 and a proximal portion 92. The distal portion 90 includes a channel 94 therethrough which extends partially into the proximal portion 92, defining a first leg 96 and a second leg 98. A projection 100 is defined at the end of the first leg 96 and defines a ledge 102 which engages edge 82 as described more fully below. The proximal portion 92 includes a curved protruding portion 104 having the same curvature as the outer edge 22 of the body 18.

Figure 12:
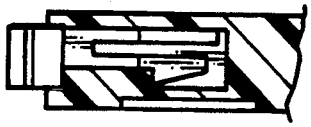
FIG. 12 is a partial side elevation view in cross section showing the insert fully inserted in a receptacle provided in accordance with the second embodiment of the present invention.
Figure 11:
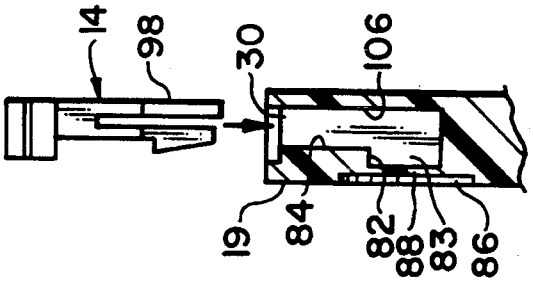
FIG. 11 is a partial side elevation view in cross section showing the insertion of an insert into a receptacle provided in accordance with the second embodiment of the present invention.
Figure 8:
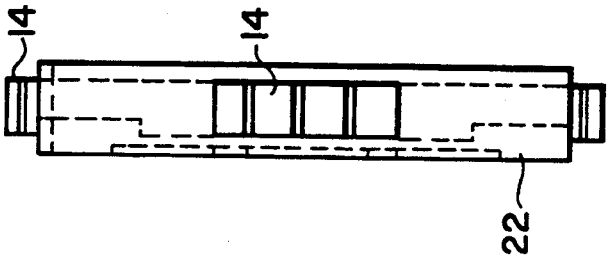
FIG. 8 is a side elevation view of the portable holder and inserts shown in FIG. 7.

Referring now more particularly to FIGS. 11 and 12, the proper orientation for placing the insert 14 into the receptacle 24 is shown. As the insert 14 is inserted, the second leg 98 slides along a first wall 106 of bore 30. The projection 100 contacts wall 84 of bore 30, causing the first leg 96 to be deflected toward the second leg 98. When the projection 100 is inserted past the second wall 106, the first leg 96 resiliently springs away from the second leg 98, thus disposing projection 100 in cut-out 83 and causing the ledge 102 to engage the locking edge 82, as shown in FIG. 12. Engagement of edge 102 and locking edge 82 prevents the removal of the insert 14. When the insert 14 is fully inserted, the curved protruding portion 104 of each insert 14 rests on the outer peripheral edge 22 of the body 18, permitting access to the insert for removal from the body 18.

To remove the insert 14 from the receptacle 24, pressure must be applied to the thin wall 88 so as to disengage edge 102 from the locking edge 82 while lifting the insert 14 from the receptacle 24. If no wall 88 is present, and the cut-out extends to the front 19 or back surface, depression of the projection 100 is required to deflect the first leg 96 beyond edge 82, releasing the insert 14 from the receptacle.

Figure 14:
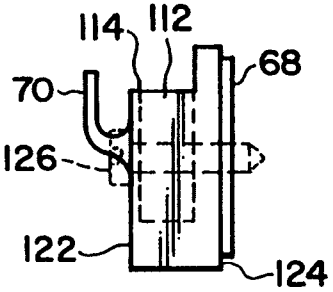
FIG. 14 is a side elevation of the storage holder shown in FIG. 13.
Figure 13:
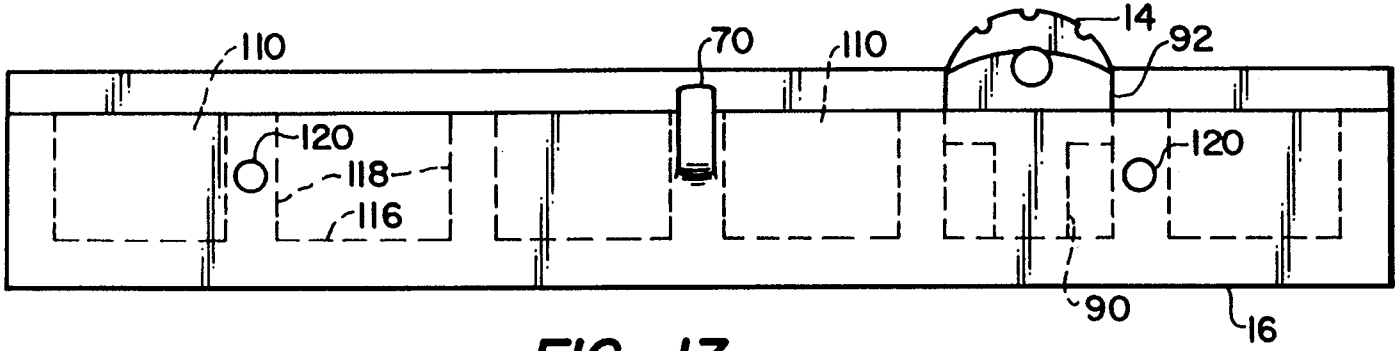
FIG. 13 is a front elevation of a storage holder containing an insert provided in accordance with the second embodiment of the present invention.

A second embodiment of the storage holder, 16, is shown in FIGS. 13 and 14. The storage holder 16 is generally similar to that of the first embodiment and corresponding parts are assigned the same reference numbers and will not be specifically discussed. A number of pockets 110 are uniformly spaced within the body, with openings 112 disposed at the top edge 114. Each pocket 112 is designed to accept an insert 14 in accordance with the second embodiment for storage, when the insert 14 is not required to be carried in the portable holder 12. The distal portion 90 of each insert 14 rests on the bottom 116 of each pocket 112. Sides 118 of each pocket hold the proximal portion 92 of the insert 14. As an alternative to the pockets 112, a series of receptacles 24 can be provided in the storage holder 16. A hook 70 is disposed on the holder 16. In addition to, or as an alternative to the mounting means 68, two holes 120 extend through the holder 16, from front surface 122 to back surface 124. A screw 126 is provided in each hole 120 for mounting.

It can be seen that the system 10 of the present invention provides an effective means of carrying, identifying and storing a variety of keys. The ability to provide a portable holder with removable color-coded inserts simplifies any required transfer of keys without confusing the identity of the keys. In addition, the storing of keys not needed to be carried, is centralized by utilizing the storage holder.

It can further be seen that the system of the invention can be modified to accommodate special needs of the user. For example, the portable holder 12 can be provided with a built in light source, or inserts can be provided which have a mini flashlight, whistle or the like, attached.

It has thus been seen that the objects of this invention have been fully and effectively accomplished. It will be realized, however, that the foregoing preferred embodiments have been shown and described for the purposes of illustrating the structural and functional principles of the present invention and are subject to change without departure from such principles. Therefore, this invention includes all modifications encompassed within the spirit of the following claims.

What is claimed is:

1. A system for identifying, carrying and storing keys comprising:

a molded portable holder including a body having a front surface, back surface, central portion and outer peripheral edge, said body including a plurality of receptacles extending from said outer peripheral edge toward said central portion, each of said receptacles including a bore and means defining a rigid locking shoulder within said bore, said locking shoulder being defined so that a longitudinal axis thereof is disposed substantially perpendicular to a longitudinal axis of said bore;

a plurality of molded inserts, each of said inserts being configured to be insertable into and removable from a said receptacle, each of said inserts having a distal portion and a proximal portion, said distal portion including a flat portion disposed parallel to a longitudinal axis thereof and a part cylindrical portion, said flat portion permitting said insert to pass said locking shoulder when said insert is inserted into said receptacle, a groove being defined in said part cylindrical portion, said groove being aligned with said locking shoulder when said insert has been inserted into said receptacle to a predetermined extent, so that said insert can be rotated about said longitudinal axis thereof after said insert has been inserted to said predetermined extent thereby to engage said locking shoulder and said groove and lock said insert in said receptacle; and means for coupling at least one key to each said insert.

2. A system as in claim 1, in combination with a storage holder including a body having a top surface, a bottom surface, front and back surfaces, a longitudinal axis, and a plurality of pockets, each of said pockets opening to one of the top and front surfaces of said body, each of said pockets sized so to accept said inserts for storing the same.

3. A system as claimed in claim 1, wherein said means defining a locking shoulder includes a pin member embedded in said body of said portable holder and oriented to extend generally from front to back of said body so that a portion of said pin member extends into said bore of said receptacle.

4. A system as claimed in claim 1, wherein said bore of each said receptacle is circular in cross-section.

5. A system as claimed in claim 1, wherein said body of said portable holder further comprises identification means including a return address and a code number.

6. A system as claimed in claim 1, wherein said means for coupling comprises a bore through said proximal portion of each said insert sized to receive one of a key chain, monofilament line and ring.

7. A system as claimed in claim 2, wherein said storage holder further comprises means for mounting to a support surface.

8. A system as claimed in claim 7, wherein said means for mounting includes two bores spaced uniformly apart in said body, having two threaded screws disposed therein, the threads of said screws extending beyond the body for mounting to the support surface.

9. A system as claimed in claim 7, wherein said means for mounting includes a hook and loop type fastener affixed to said back surface of said body.

10. A system as claimed in claim 7, wherein said means for mounting includes double-backed adhesive tape disposed on said back surface of said body.

11. A system as claimed in claim 1, wherein said inserts are different colors to thereby allow visual identification of the keys coupled thereto.

12. A system as claimed in claim 1, wherein each said insert further includes a plurality of at least one of projections and recesses defined in said proximal portion to thereby allow tactile identification of the keys coupled thereto.

13. A system as claimed in claim 1, wherein said portable body and each of said inserts are molded from plastic material.

14. A system as claimed in claim 3, wherein said pin member is circular in cross-section.

15. A kit for carrying and storing keys comprising:

a molded portable holder including a body having a front surface, back surface, central portion and outer peripheral edge, said body including a plurality of receptacles extending from said outer peripheral edge toward said central portion, each of said receptacles including a bore and means defining a locking shoulder within said bore, said locking shoulder being defined so that a longitudinal axis thereof is disposed substantially perpendicular to a longitudinal axis of said bore;

a plurality of molded inserts, each of said inserts being configured to be insertable into and removable from a said receptacle, each of said inserts having a distal portion and a proximal portion, said distal portion including a flat portion disposed parallel to a longitudinal axis thereof and a part cylindrical portion, said flat portion permitting said insert to pass said locking shoulder when said insert is inserted into said receptacle, a groove being defined in said part cylindrical portion, said groove being aligned with said locking shoulder when said insert has been inserted into said receptacle to a predetermined extent, so that said insert can be rotated about said longitudinal axis thereof after said insert has been inserted to said predetermined extent thereby to engage said locking shoulder and said groove and lock said insert in said receptacle;

means for coupling at least one key to each said insert; and a molded storage holder having a plurality of pockets defined therein, each said pocket being sized and oriented to receive and temporarily retain a said insert therein for storing the same when not attached to said portable holder.

16. A kit as claimed in claim 15, wherein said pockets and said inserts each have a circular cross-section.

17. A kit as claimed in claim 15, wherein said bore of said receptacle is circular in cross-section.

18. A kit as claimed in claim 15, wherein said body of said portable holder further comprises identification means including an address and a code number.

19. A kit as claimed in claim 15, wherein said means for coupling comprises a bore through said proximal portion of said insert sized to receive one of a key chain, monofilament line and ring.

20. A kit as claimed in claim 15, wherein said storage holder further comprises means for mounting to a support surface.

21. A kit as claimed in claim 15, wherein said inserts are each a different color to thereby allow visual identification of the keys respectively coupled thereto.

22. A kit as claimed in claim 15, wherein each said insert further includes a plurality of at least one of projections and recesses defined in said proximal portion to thereby allow tactile identification of the keys coupled thereto.

23. A kit as claimed in claim 15, wherein said portable body, said inserts and said storage holder are each molded from plastic material.

* * * * *